United States Patent [19]

Glass

[11] 4,236,665

[45] Dec. 2, 1980

[54] MAIL BOX POST BRACKET

[76] Inventor: Carl R. Glass, 1036 Partin Dr., Kissimmee, Fla. 32741

[21] Appl. No.: 37,611

[22] Filed: May 10, 1979

[51] Int. Cl.[3] ..... B65D 91/00

[52] U.S. Cl. ..... 232/39; 248/158

[58] Field of Search ..... 232/39, 38; 248/146, 248/158, 188.1, 177, 357; 52/295, 292, 698, 703

[56] References Cited

U.S. PATENT DOCUMENTS

| | | | |
|---|---|---|---|
| 1,122,746 | 12/1914 | Halling | 232/39 X |
| 1,919,838 | 7/1933 | Hadly | 248/158 |
| 1,994,186 | 3/1935 | Anderson | 232/39 |
| 2,470,011 | 5/1949 | Winter et al. | 248/158 |
| 2,513,630 | 7/1950 | Elliott | 248/146 UX |
| 3,015,466 | 1/1962 | Levy | 248/158 |
| 4,078,757 | 3/1978 | Waters | 248/158 |

FOREIGN PATENT DOCUMENTS

| | | | |
|---|---|---|---|
| 531711 | 3/1929 | Fed. Rep. of Germany | 248/357 |

*Primary Examiner*—Roy D. Frazier
*Assistant Examiner*—Peter A. Aschenbrenner
*Attorney, Agent, or Firm*—Sughrue, Rothwell, Mion, Zinn and Macpeak

[57] ABSTRACT

A bracket for mounting a mail box or the like has a pair of substantially identical upper and lower plate numbers each having surrounding walls. A series of open housings project from the plate members, and are interconnected to one another and to the walls by reinforcing ribs. The housings have interior vertical splines, and elongated posts are engaged in aligned pairs of the housings and frictionally locked therein by the splines. The lower plate member is embedded in the earth along with portions of the posts, and a mailbox is secured to the exposed, upper plate member.

6 Claims, 5 Drawing Figures

FIG 1
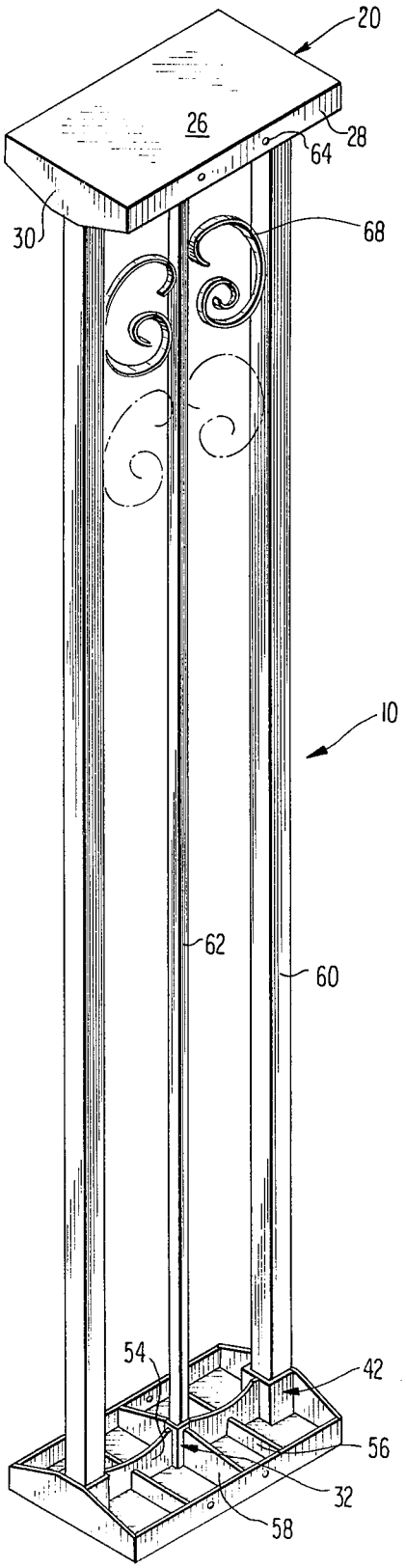
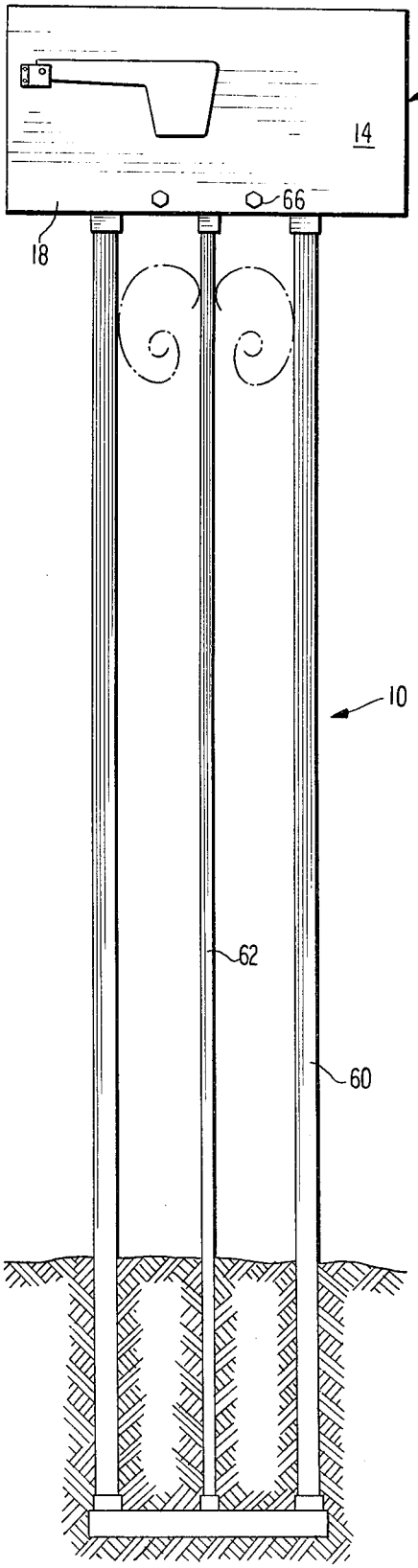
FIG 2

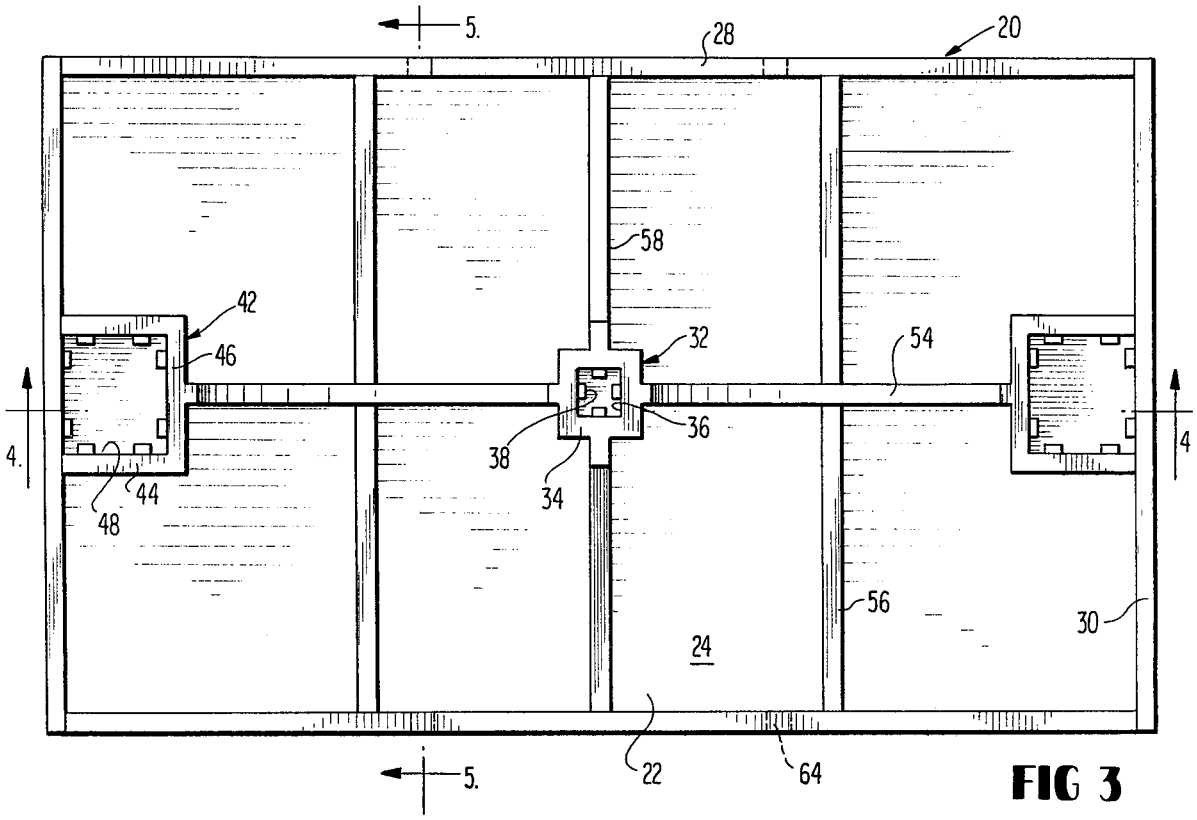
FIG 3
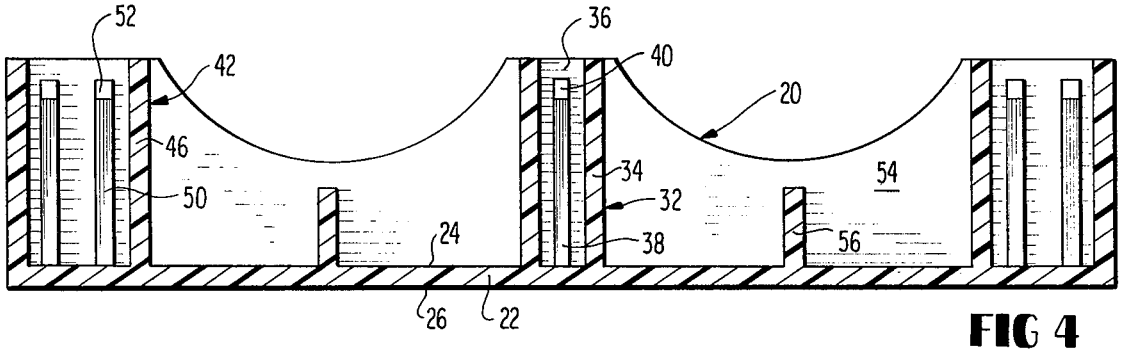
FIG 4
FIG 5
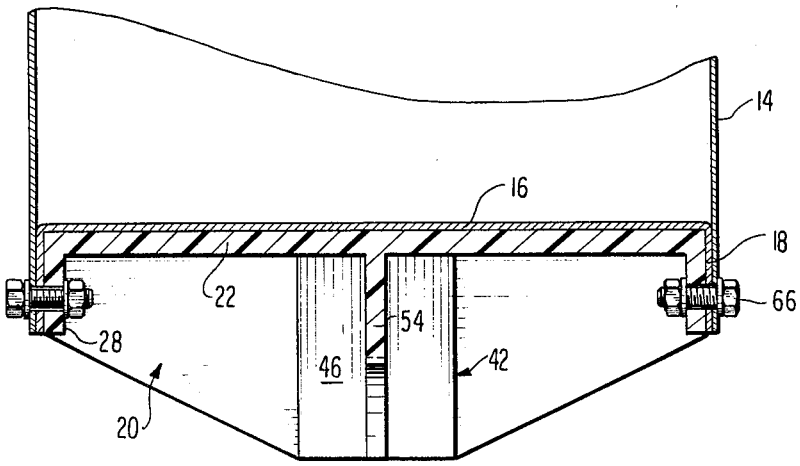

MAIL BOX POST BRACKET

BACKGROUND OF THE INVENTION

1. Field of the Invention

This invention pertains to the mounting of mail boxes and similar items requiring post-type installation.

2. Statement of the Prior Art

Prior proposals in the general area of mail box mounting and post construction are illustratively shown in the below-listed prior U.S. patents:

| Patentee | Patent No. | Issue Date |
|---|---|---|
| P. A. Rennack | 1,764,226 | June 17, 1930 |
| M. G. Zachrich | 2,552,915 | May 15, 1951 |
| J. Fuhrmann | 2,669,117 | Feb. 16, 1954 |
| Kreizel et al. | 3,730,109 | May 1, 1973 |
| Seiling, D. W. | 3,743,226 | July 3, 1973 |
| Cecchetti | 3,865,050 | Feb. 11, 1975 |
| Waters | 4,078,757 | Mar. 14, 1978 |

SUMMARY OF THE INVENTION

The mail box bracket of this invention is characterized by economy of fabrication and installation through the elimination of need for welding or other costly assembly techniques, and the elimination of need for concrete footing. In meeting this objective, the invention provides for on-site assembly of the components through frictional engagement, thereby further providing for a compact shipping configuration. The invention proposes the use of identical upper and lower plates, each with open housings or sleeves which engage vertical posts or tube. The lower plate is embedded in the earth with the upper plate at desired height, and earth is tamped about the lower plate and post sections, firmly setting the post bracket in place. A conventional mail box, with depending flanges, is then secured to the upper plate by changeable fasteners such as screws. The appearance of the unit may be enhanced by the application of decorative scrolls or the like to the posts.

Other and further objects and advantages of the invention will become apparent to those skilled in the art from a consideration of the following specification when read in conjunction with the annexed drawings.

BRIEF DESCRIPTION OF THE DRAWINGS

FIG. 1 is a perspective view illustrating an assembled unit of mail box post bracket constructed and assembled in accordance with the teachings of this invention;

FIG. 2 is a side elevational view of the unit as typically installed;

FIG. 3 is an enlarged plan view of one of the plate members as seen from its inner surface;

FIG. 4 is a longitudinal cross-sectional view taken substantially on line 4—4 of FIG. 3, looking in the direction of the arrows; and FIG. 5 is a transverse sectional view on lines 5—5 of FIG. 3 with the mail box in place.

DESCRIPTION OF THE PREFERRED EMBODIMENT

Referring to the drawing in more detail, a mail box post bracket according to this invention is generally designated therein by reference 10. The post assembly is ideally suited for use in mounting of a mail box 12 having a metallic wall 14 and a flat base 16. The base 16 and wall 12 have co-extensive side areas forming side flanges 18 on the mail box.

The post bracket assembly 10 includes a pair of substantially identical plate members 20 which are oriented in installed position to become upper and lower plate members. Each has a substantially rectangular, flat main body section 22 with inner and outer surfaces 24, 26. A peripheral wall projects from the inner surface, including side walls 28, and end walls, 30. Also projecting vertically from the inner surfaces 24 are open housings including a central housing 32. The housing 32 is of generally square form, having four walls 34 comprising sides and ends and being open at its distal extremity. The sides and ends of the central housing have an inside surface 36, and a plurality of vertical splines 38 with tapered entry portions 40 are provided thereon.

The housings further include enlarged end housing 42, at the opposite ends of the plate. Each of them has sides 44 and an inner end 46. A portion of the end wall 30 also forms a part of the end housings. The inside surfaces 48 of the end housings also have vertical splines 50 thereon, with tapered entry ends 52.

As best illustrated in FIG. 3, identical longitudinal ribs 54 extend between the ends of the housing 32 and the end walls 46 of the respective housings 42, being integral also with the plate member. Transverse ribs 56 span the area between the mid-lengths of the ribs 54 and the sidewalls 28, while central ribs 58 extend from the housing 32 to said walls.

Referring to FIGS. 1 and 2 it will there be noticed that the invention includes a pair of elongated outer post members 60 of a configuration and dimension which adapt them for frictional locking engagement in the housing 42. The splines in said housings tend to bite into the material of fabrication of the post to insure a secure engagement thereof. Similarly, a central post 62 is connected in the aligned central housings 32 of the upper and lower plates, again being engaged by the splines.

With the post bracket 10 thus assembled, as seen in FIG. 2, the lower plate is embedded in the earth at the selected depth and earth is tamped thereabout. The side walls 28 have holes 64 aligned with holes in mail box flanges 18 and nut and bolt fasteners 66 are employed to secure the mail box in place with the base 16 thereof bearing against the outer surface 26 of the upper plate.

Decorative scrolls 68 or the like may be applied to the posts if desired.

I claim:

1. The combination, with the mail box having a base and side flanges extending downwardly on opposite sides of the base, of a post bracket assembly comprising:

a pair of substantially identical upper and lower plate members;

each of the plate members having a substantially rectangular main body section with an outer surface and an inner surface, and side walls and end walls extending from the inner surface;

a plurality of housings on the inner surface, including a central housing and enlarged housings at each end wall;

the central housing including sides and ends each having an inside surface;

the end housings having interior ends and sides with the sides connected to the end walls of the plate members, the end housings having inside surfaces;

a plurality of vertical splines on the inside surfaces;

longitudinal reinforcing ribs extending between the ends of the central housing and the end housings;

transverse reinforcing ribs extending between the longitudinal ribs and the side walls of the plate members;

elongated outer post members engaged frictionally in the end housings and an elongated center post engaged frictionally in the central housing with the plate members facing one another;

decorative scroll members secured to the post; and one of the plate members being embedded in the earth, and the side flanges of the mail box being secured to the side walls of the other plate member with the base of the mail box engaged against the outer surface thereof.

2. The invention of claim 1, and:

a series of tapered splines in each of the housings biting against the posts engaged in said housings.

3. The invention of claim 1, wherein:

the housings are arranged in longitudinal alignment on the plate members substantially centrally thereof.

4. The invention of claim 1, and:

identical longitudinal reinforcing ribs extending between the housings, and a plurality of transvers ribs between the longitudinal ribs and the side walls of the faces.

5. The invention of claim 1, wherein:

the plates have side and end walls;

the housings includes a central housing and end housings, the central housing being smaller in cross-sectional dimension than the end housings, and reinforcing ribs spanning the area between said central housing and the side walls, and the end housings being connected to the end wall.

6. A mounting bracket assembly comprising:

a pair of upper and lower plate members;

the plate members having facing surfaces and a peripheral wall projecting from said surfaces;

a central open housing of square cross-sectional dimension and a plurality of open housings of square cross-sectional dimension different from the cross-sectional dimension of said central open housing extending from the facing surface of the plate members; and a plurality of posts of cross-sectional dimension matching the cross-sectional dimensions of said housings frictionally engaged in the housings of the respective plate members.

* * * * *